US011665478B2

(12) United States Patent
Ozawa

(10) Patent No.: US 11,665,478 B2
(45) Date of Patent: May 30, 2023

(54) ACOUSTIC DIAPHRAGM, METHOD OF MANUFACTURING ACOUSTIC DIAPHRAGM, AND ELECTROACOUSTIC TRANSDUCER

(71) Applicant: Audio-Technica Corporation, Tokyo (JP)

(72) Inventor: Hiromichi Ozawa, Kanagawa (JP)

(73) Assignee: AUDIO-TECHNICA CORPORATION, Tokyo (JP)

( * ) Notice: Subject to any disclaimer, the term of this patent is extended or adjusted under 35 U.S.C. 154(b) by 179 days.

(21) Appl. No.: 17/360,091

(22) Filed: Jun. 28, 2021

(65) Prior Publication Data

US 2021/0329383 A1 Oct. 21, 2021

Related U.S. Application Data

(62) Division of application No. 16/711,514, filed on Dec. 12, 2019, now Pat. No. 11,317,214.

(30) Foreign Application Priority Data

Dec. 14, 2018 (JP) ..... JP2018-234364

(51) Int. Cl.

| | |
|---|---|
| ***H04R 7/12*** | (2006.01) |
| ***H04R 9/06*** | (2006.01) |
| ***H04R 7/18*** | (2006.01) |
| ***H04R 9/02*** | (2006.01) |
| ***H04R 31/00*** | (2006.01) |

(52) U.S. Cl.

CPC ..... *H04R 7/127* (2013.01); *H04R 7/18* (2013.01); *H04R 9/025* (2013.01); *H04R 9/06* (2013.01); *H04R 31/003* (2013.01); *H04R 2400/11* (2013.01)

(58) Field of Classification Search

CPC ..... H04R 7/127; H04R 7/18; H04R 9/025; H04R 9/06; H04R 31/003; H04R 2400/11; H04R 2307/207; H04R 7/12; H04R 2231/001; H04R 2307/00

See application file for complete search history.

(56) References Cited

U.S. PATENT DOCUMENTS

2006/0256997 A1* 11/2006 Sagren ..... H04R 9/063 381/412
2011/0026757 A1* 2/2011 Takahashi ..... H04R 31/003 381/397
2015/0117698 A1* 4/2015 Bullimore ..... H04R 7/16 381/398

* cited by examiner

*Primary Examiner* — Tuan D Nguyen
(74) *Attorney, Agent, or Firm* — WCF IP

(57) ABSTRACT

An acoustic diaphragm 1 according to the present invention includes a center dome member, and a sub dome member. The center dome member includes a center dome 2 and an annular first plane part 2*a* that is disposed along the outer periphery of the center dome and formed integrally with the center dome. The sub dome member includes a sub dome 3 and an annular second plane part 3*a* that is disposed along the inner periphery of the sub dome and formed integrally with the sub dome. The first plane part includes a rising part 2*b* of the center dome, a first front surface, and a first back surface. The second plane part includes an inner peripheral edge 3*b*, a second front surface, and a second back surface. The center dome is formed of a material different from that of the sub dome. The sub dome surrounds the periphery of the center dome. The inner peripheral edge coincides with the rising part. The first front surface is joined to the second back surface.

2 Claims, 5 Drawing Sheets

ACOUSTIC DIAPHRAGM, METHOD OF MANUFACTURING ACOUSTIC DIAPHRAGM, AND ELECTROACOUSTIC TRANSDUCER

TECHNICAL FIELD

The present invention relates to an acoustic diaphragm having a center dome and a sub dome formed by different types of materials, a method of manufacturing the acoustic diaphragm, and an electroacoustic transducer.

BACKGROUND ART

For example, the related acoustic diaphragm used for dynamic headphones generally includes a center dome (main dome) and a sub dome that surrounds the periphery of the center dome. In the acoustic diaphragm, a voice coil is attached to a boundary part between the side of a back surface of the center dome and the side of a back surface of the sub dome.

The acoustic diaphragm is formed by pressing or heating a thin plate-shaped film made of thermoplastic resin, for example. An outer peripheral flange part of the sub dome is attached to a unit frame. Furthermore, the acoustic diaphragm receives electromagnetic force generated in the voice coil disposed in a magnetic gap and vibrates in a direction orthogonal to a surface of the diaphragm.

Meanwhile, in the related acoustic diaphragm, there are many examples in which the center dome and the sub dome are formed integrally with each other using the thin plate-shaped film as a material.

According to this, in order to obtain desired vibration characteristics of the diaphragm, the material for forming the sub dome needs to have a certain degree of softness. On the other hand, the center dome formed of the same material as the sub dome is deformed by receiving driving force of the voice coil. Therefore, a relation between the driving force and sound pressure is not linear. As a consequence, a problem such as deterioration of frequency response and an increase in distortion occurs in the acoustic diaphragm.

Consequently, the material of the acoustic diaphragm used for the dynamic headphones is selected in consideration of both material softness required for the sub dome and appropriate material hardness (rigidity) required for the center dome.

In this regard, there has been proposed an acoustic diaphragm having a center dome and a sub dome that are individually formed using different types of materials and bonded using an adhesive, for example.

According to this proposal, the acoustic diaphragm, which has a sub dome formed using a resin material capable of exhibiting material softness and a center dome formed using a thin plate made of a metal such as magnesium or a wood plate (wood), has been commercialized.

Furthermore, there has been proposed an electroacoustic transducer using an acoustic diaphragm including a center dome and a sub dome formed of separate members and bonded, or a center vibrator and an annular vibrator (for example, refer to Japanese Patent Application Publication No. 2006-217122 and Japanese Patent Application Publication No. 2007-060463).

The electroacoustic transducer disclosed in Japanese Patent Application Publication No. 2006-217122 includes a bobbin formed integrally with the peripheral edge of the center dome in a cylindrical shape and a flange part at a rear end of the bobbin. The flange part is configured to position a voice coil when the voice coil is mounted on the bobbin.

In the electroacoustic transducer disclosed in Japanese Patent Application Publication No. 2006-217122, when the voice coil is bonded and fixed to the bobbin, an assembly procedure of the next process can be started without waiting for the solidification of an adhesive, so that it is possible to improve productivity.

Furthermore, the electroacoustic transducer disclosed in Japanese Patent Application Publication No. 2007-060463 includes a projector of the center vibrator outside an adhesive area between the center vibrator and the annular vibrator. In the electroacoustic transducer disclosed in Japanese Patent Application Publication No. 2007-060463, a voice coil is mounted on the projector. With such a configuration, the electroacoustic transducer can employ a larger magnet. As a consequence, the magnetic flux density of a magnetic gap is increased and an electroacoustic transducer with high acoustic conversion efficiency is provided.

SUMMARY OF INVENTION

Technical Problem

Meanwhile, in the electroacoustic transducers disclosed in Japanese Patent Application Publication No. 2006-217122 and Japanese Patent Application Publication No. 2007-060463, the peripheral edge part of the center dome is joined to the inner peripheral part of the sub dome by an adhesive. However, Japanese Patent Application Publication No. 2006-217122 and Japanese Patent Application Publication No. 2007-060463 do not propose positioning between the center dome and the sub dome. In general, it is not possible to position the sub dome concentrically with respect to the center dome as a guide.

Consequently, a special jig is required for positioning between the center dome and the sub dome, and an elapsed time for mounting a diaphragm on the jig is required until an adhesive is solidified to some extent.

An object of the present invention is to facilitate positioning between a center dome and a sub dome and improve productivity.

Solution to Problem

An acoustic diaphragm according to the present invention includes a center dome member and a sub dome member. The center dome member includes a center dome and an annular first plane part that is disposed along an outer periphery of the center dome and formed integrally with the center dome. The sub dome member includes a sub dome and an annular second plane part that is disposed along an inner periphery of the sub dome and formed integrally with the sub dome. The first plane part includes a rising part of the center dome, a first front surface and a first back surface. The second plane part includes an inner peripheral edge, a second front surface and a second back surface. The center dome is formed of a material different from a material of the sub dome. The sub dome surrounds a periphery of the center dome. The inner peripheral edge coincides with the rising part. The first front surface is joined to the second back surface.

The material of the center dome may be a material harder than the material of the sub dome. In addition, the inner peripheral edge and the rising part may be circular. Furthermore, the acoustic diaphragm may further include a voice coil that constitutes an electroacoustic transducer, the voice coil being attached to a side of the first back surface.

In a method of manufacturing an acoustic diaphragm according to the present invention, the acoustic diaphragm includes a center dome member and a sub dome member. The center dome member includes a center dome and an annular first plane part that is disposed along an outer periphery of the center dome and formed integrally with the center dome. The sub dome member includes a sub dome and an annular second plane part that is disposed along an inner periphery of the sub dome and formed integrally with the sub dome. The first plane part includes a rising part of the center dome, a first front surface and a first back surface. The second plane part includes an inner peripheral edge, a second front surface and a second back surface. The center dome is formed of a material different from a material of the sub dome. The sub dome surrounds a periphery of the center dome. The inner peripheral edge coincides with the rising part. The method of manufacturing the acoustic diaphragm includes the steps of preparing the center dome member and the sub dome member and joining the second back surface to the first front surface in a state where the inner peripheral edge is aligned with the rising part.

In the step of joining the second back surface to the first front surface, an adhesive may be interposed between the first front surface and the second back surface to join the first plane part and the second plane part.

An electroacoustic transducer according to the present invention includes a magnetic circuit unit, a unit frame including the magnetic circuit unit, a voice coil that is disposed in a magnetic gap formed in the magnetic circuit unit and an acoustic diaphragm that is attached to the unit frame and to which the voice coil is attached. The acoustic diaphragm is the aforementioned acoustic diaphragm. The sub dome member of the acoustic diaphragm includes a flange part that is disposed on an outer periphery of the sub dome member. The flange part is attached to the unit frame and the voice coil is attached to a back surface on a center side of the acoustic diaphragm.

Advantageous Effects of Invention

According to the present invention, when the center dome member and the sub dome member are joined, the inner peripheral edge of the second plane part of the sub dome member coincides with the rising part of the center dome in the first plane part of the center dome member in an overlapping direction.

Consequently, the present invention can facilitate positioning between the center dome member and the sub dome member and can contribute to improving productivity of an acoustic diaphragm.

In addition, the voice coil is attached to the side of the back surface of the first plane part formed integrally with the center dome. Therefore, the center dome formed of a harder material than the sub dome is directly driven by the voice coil. In this way, the present invention can provide an acoustic diaphragm having excellent frequency response and low reproduction distortion and an electroacoustic transducer using the acoustic diaphragm.

DESCRIPTION OF EMBODIMENTS

Figure 1:
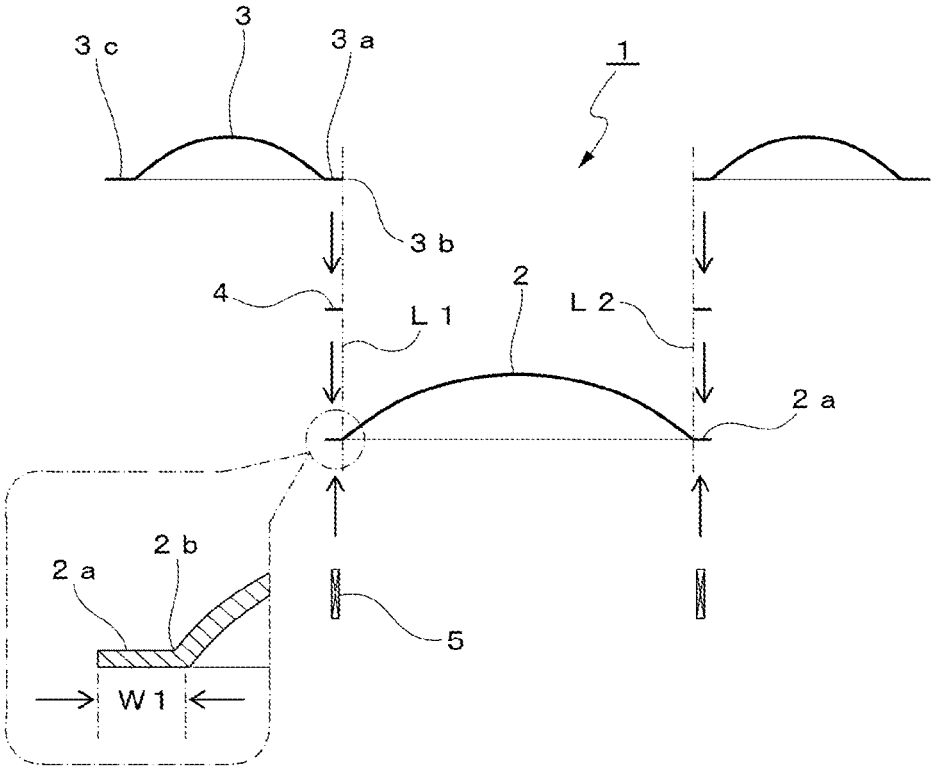
FIG. 1 is a cross-sectional view for explaining a basic configuration and a method of manufacturing an acoustic diaphragm of a first embodiment according to the present invention.

An acoustic diaphragm according to the present invention, a method of manufacturing the acoustic diaphragm, and an electroacoustic transducer will now be described based on embodiments illustrated in the drawings. The acoustic diaphragm illustrated in each drawing is illustrated in the form of a cut end surface in a state of being cut at the center thereof, and illustration of some of members appearing on the back side of each drawing will be omitted as appropriate.

FIG. 1 illustrates a first embodiment of an acoustic diaphragm. An acoustic diaphragm 1 of the first embodiment includes a center dome 2 and a sub dome 3 that surrounds the periphery of the center dome 2.

In the center dome 2, a front surface of the diaphragm projects so as to form a part of a spherical surface. In the sub dome 3, the front surface of the diaphragm projects in an annular shape (doughnut shape). The sub dome 3 surrounds the periphery of the center dome 2.

In the center dome 2, an annular first plane part 2*a* is formed (disposed) along the outer periphery of the center dome 2. The first plane part 2*a* is formed integrally with the center dome 2. The first plane part 2*a* is formed in a direction orthogonal to a vibration direction of the diaphragm 1.

A rising part 2*b* of the center dome 2 between the first plane part 2*a* and the center dome 2 is formed in a state substantially close to a perfect circle in a plan view. In other words, the rising part 2*b* of the center dome 2 is an inner peripheral edge of the first plane part 2*a*. Furthermore, an outer peripheral edge of the first plane part 2*a* is formed in a state substantially close to a perfect circle. Consequently, as illustrated in the partially enlarged view of FIG. 1, a width W1 of the first plane part 2*a* along the outer periphery of the center dome 2 is formed to be substantially uniform along the periphery thereof. The width W1 is a length from the rising part 2*b* of the center dome 2 (the inner peripheral edge of the first plane part 2*a*) to the outer peripheral edge of the first plane part 2*a* in the first plane part 2*a*.

In the first embodiment, the width W1 of the first plane part 2*a* is set to about 0.5 mm.

Meanwhile, in the sub dome 3, an annular second plane part 3*a* is formed (disposed) along the inner periphery of the sub dome 3. The second plane part 3*a* is formed integrally with the sub dome 3. The second plane part 3*a* is formed in a direction orthogonal to the vibration direction of the diaphragm 1. As indicated by chain lines L1 and L2, an inner peripheral edge 3*b* of the second plane part 3*a* coincides with the rising part 2*b* of the center dome 2 in the first plane part 2*a* in a concentric circle in an overlapping direction.

Consequently, the center dome 2 is centered and the sub dome 3 is fitted from above the center dome 2 so as to overlap the center dome 2, so that the inner peripheral edge 3*b* of the second plane part 3*a* coincides with the rising part 2*b* of the center dome 2 in the overlapping direction. That is, when the sub dome 3 is overlapped on the center dome 2, the inner peripheral edge 3*b* of the second plane part 3*a* coincides with the rising part 2*b* (the inner peripheral edge of the first plane part 2*a*) of the center dome 2 in the overlapping direction. In this way, the sub dome 3 can be positioned concentrically with respect to the center dome 2.

In addition, in the sub dome 3, a flange part 3*c* is formed (disposed) along the outer periphery of the sub dome 3. The flange part 3*c* is an annular plane part. The flange part 3*c* is formed integrally with the sub dome 3. The flange part 3*c* is used to attach the acoustic diaphragm 1 to a unit frame to be described below.

Reference numeral 4 indicates an adhesive for joining a center dome member and a sub dome member. The adhesive 4 is an adhesive including a solvent, for example, and is applied to an upper surface (front surface) of the first plane part 2*a* or applied to a bottom surface (back surface) of the second plane part 3*a*. Next, the second plane part 3*a* is overlapped on the upper surface of the first plane part 2*a*, so that both (the first plane part 2*a* and the second plane part 3*a*) are joined. In this way, the acoustic diaphragm 1 is formed. The center dome member and the sub dome member will be described below.

In such a case, as described above, positioning between the center dome 2 and the sub dome 3 is performed.

In the acoustic diaphragm 1 of the first embodiment illustrated in FIG. 1, after the center dome member (the center dome 2 and the first plane part 2*a*) and the sub dome member (the sub dome 3, the second plane part 3*a*, and the flange part 3*c*) are joined, a voice coil 5 is attached to the side of a back surface of the first plane part 2*a*.

The voice coil 5 is a wire in which a copper or aluminum wire is covered with an insulating layer made of a high heat-resistant resin and an outer periphery of the insulating layer is covered with a fusion layer of a thermoplastic resin. The voice coil 5 has a bobbin-less structure by heating and solidifying the fusion layer in a state where the wire is wound in a coil shape. The voice coil 5 is attached to the side of the back surface of the first plane part 2*a* by the adhesive 4.

The voice coil 5 is not limited to the bobbin-less structure. That is, for example, the voice coil 5 may have a structure using a bobbin.

The center dome 2 and the annular first plane part 2*a* constitute the center dome member. As a material of the center dome member, a metal material such as titanium or aluminum alloy, or a non-metal material made of carbon called dry carbon is preferably used.

On the other hand, the sub dome 3, the annular second plane part 3*a*, and the flange part 3*c* constitute the sub dome member. As a material of the sub dome member, for example, a thermoplastic resin material such as polyethylene terephthalate (PET) is preferably used.

That is, the center dome 2 is made of a harder material than the sub dome 3. In this way, for example, the acoustic diaphragm 1 used for dynamic headphones has characteristics of material softness required for the sub dome 3 and material hardness (rigidity) required for the center dome 2.

Consequently, in order to manufacture the aforementioned acoustic diaphragm 1, the center dome member and the sub dome member are prepared. As described above, the center dome member is formed of a material such as titanium or carbon and includes the annular first plane part 2*a* formed along the outer periphery of the center dome 2. As described above, the sub dome member is formed of a material such as polyethylene terephthalate (PET) and includes the annular second plane part 3*a* formed along the inner periphery of the sub dome 3. The inner peripheral edge 3*b* of the second plane part 3*a* coincides with the rising part 2*b* of the center dome 2 in the first plane part 2*a* (the inner peripheral edge of the first plane part 2*a*).

Next, in the state where the inner peripheral edge 3*b* of the second plane part 3*a* is aligned with the rising part 2*b* of the center dome 2 in the first plane part 2*a*, the back surface of the second plane part 3*a* is joined to the front surface of the first plane part 2*a* by using the adhesive 4. In this way, the acoustic diaphragm 1 is manufactured.

When an adhesive including a solvent is used as the adhesive 4, the adhesive is applied to the front surface of the first plane part 2*a* or applied to the back surface of the second plane part 3*a*. In this way, both (the first plane part 2*a* and the second plane part 3*a*) are joined and solidified.

On the other hand, for example, when a hot melt adhesive and the like are used as the adhesive 4, the hot melt adhesive is interposed between the first plane part 2*a* and the second plane part 3*a* and thermally compressed, so that both are joined and fixed. In this way, the acoustic diaphragm 1 is obtained.

Figure 2:
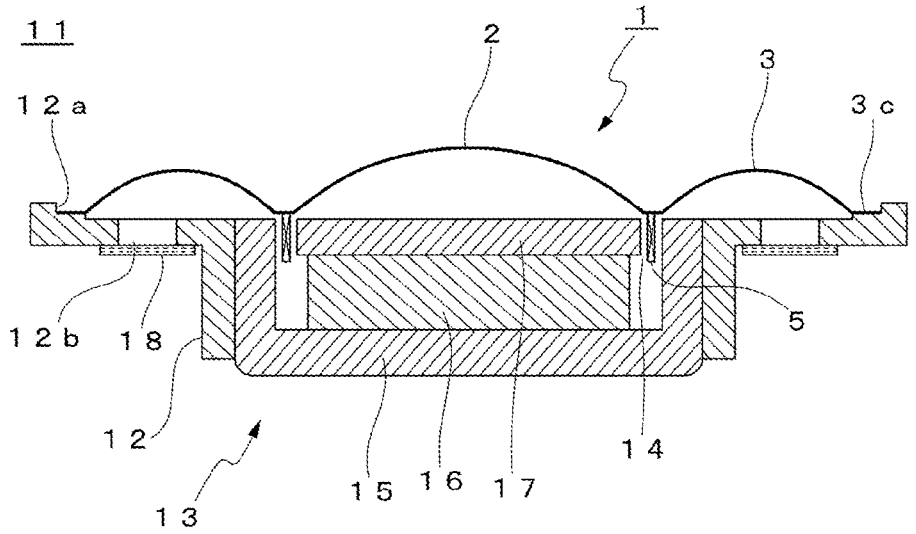
FIG. 2 is a cross-sectional view of an electroacoustic transducer including the acoustic diaphragm of the first embodiment.

FIG. 2 is a central cross-sectional view illustrating an example of an electroacoustic transducer 11 including the acoustic diaphragm 1 of the present invention.

In the electroacoustic transducer 11, the flange part 3*c* of the acoustic diaphragm 1 is attached to a front opening edge 12*a* of a unit frame 12. A magnetic circuit unit 13 is attached to a center part of the unit frame 12. The voice coil 5 is disposed inside an annular magnetic gap 14 in the magnetic circuit unit 13. The magnetic circuit unit 13 includes a yoke 15 formed in a bottomed cylindrical shape. A magnet 16 and a pole piece 17 are accommodated in the yoke 15. The magnetic gap 14 is formed between the pole piece 17 and the yoke 15.

Furthermore, a peripheral side surface of the yoke 15 constituting the outline of the magnetic circuit unit 13 is attached to a central hole formed in the unit frame 12. In this way, the electroacoustic transducer 11 is configured.

The unit frame 12 includes a plurality of circular openings 12*b*. The plurality of openings 12*b* are formed at equal intervals along the circumferential direction of the unit frame 12. The plurality of openings 12*b* are formed along the side of the back surface of the sub dome 3 in the acoustic diaphragm 1 and are formed so as to communicate with a back surface of the unit frame 12.

An acoustic resistance material 18 made of a nonwoven fabric and the like is attached to the side of the back surface of the unit frame 12 so as to block the opening 12*b*. The acoustic resistance material 18 adjusts an air flow rate between a space, which is formed between the acoustic diaphragm 1 and the unit frame 12, and a back space of the unit frame 12.

The electroacoustic transducer 11, for example, is used for dynamic headphones in which a diameter of the acoustic diaphragm 1 is about 50 mm.

FIG. 3 to FIG. 9 illustrate second to eighth embodiments of the acoustic diaphragm 1 according to the present invention. Each drawing is illustrated in the form of a cut end surface of the acoustic diaphragm 1 in a state of being cut at the center thereof, as in the first embodiment illustrated in FIG. 1.

In each embodiment illustrated in each drawing, since members denoted by the same reference numerals as those of the first embodiment illustrated in FIG. 1 have the same functions as those in the first embodiment, a description thereof will be omitted.

Furthermore, in each embodiment illustrated in each drawing, as in the first embodiment illustrated in FIG. 1, the rising part 2*b* of the center dome 2 in the first plane part 2*a* and the inner peripheral edge 3*b* of the second plane part 3*a* coincide with each other in a concentric circle in an overlapping direction. Moreover, in each embodiment illustrated in each drawing, the voice coil 5 is attached to the side of the back surface of the first plane part 2*a*.

Figure 3:
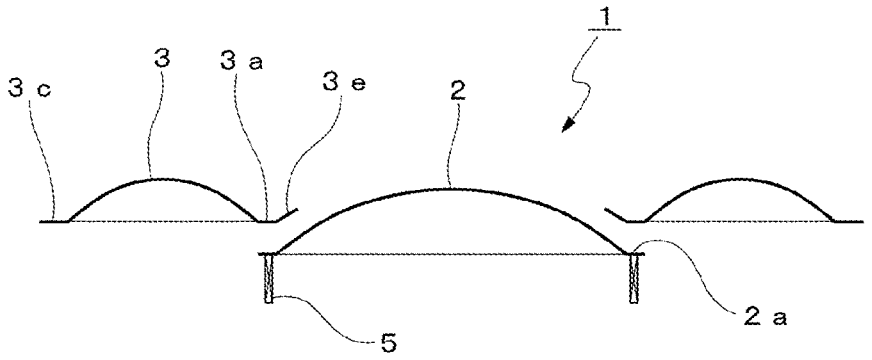
FIG. 3 is a cross-sectional view illustrating a second embodiment of the acoustic diaphragm according to the present invention.

In the second embodiment illustrated in FIG. 3, the sub dome member includes an annular extension part 3*e* that overlaps the center dome 2 subsequent to the second plane part 3*a*. The annular extension part 3*e* is formed integrally with the sub dome 3. According to this example, the annular extension part 3*e* is disposed to overlap the periphery of the center dome 2. Therefore, adhesive force between the center dome member and the sub dome member is further increased.

Figure 4:
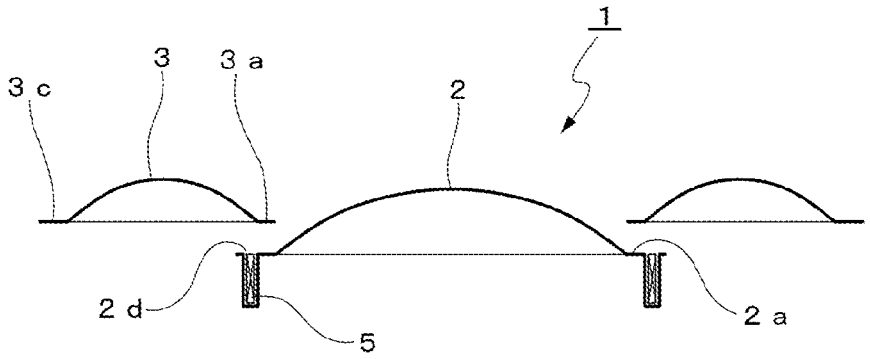
FIG. 4 is a cross-sectional view illustrating a third embodiment of the acoustic diaphragm according to the present invention.

In the third embodiment illustrated in FIG. 4, the center dome member includes an annular slot part 2*d* on the outer periphery of the first plane part 2*a* subsequent to the center dome 2. The annular slot part 2*d* is formed integrally with the center dome 2. The voice coil 5 is mounted in the slot part 2*d*.

Figure 5:
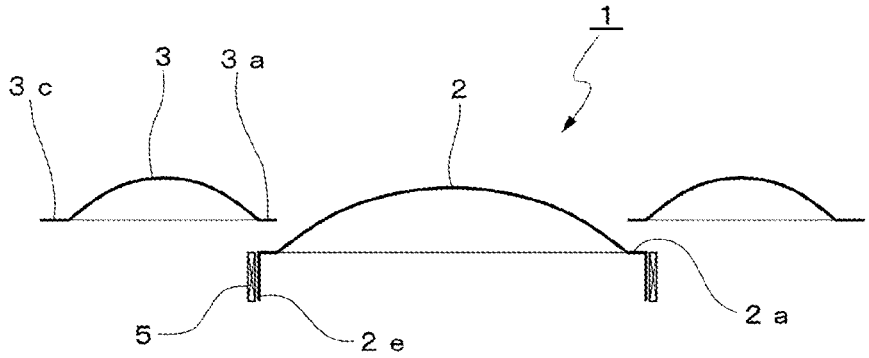
FIG. 5 is a cross-sectional view illustrating a fourth embodiment of the acoustic diaphragm according to the present invention.

In the fourth embodiment illustrated in FIG. 5, the center dome member includes a cylindrical part 2*e* outside the first plane part 2*a* subsequent to the center dome 2. The cylindrical part 2*e* extends to the side of the back surface of the first plane part 2*a*. The cylindrical part 2*e* is formed integrally with the center dome 2. The voice coil 5 is mounted along an outer peripheral surface of the cylindrical part 2*e*.

Figure 6:
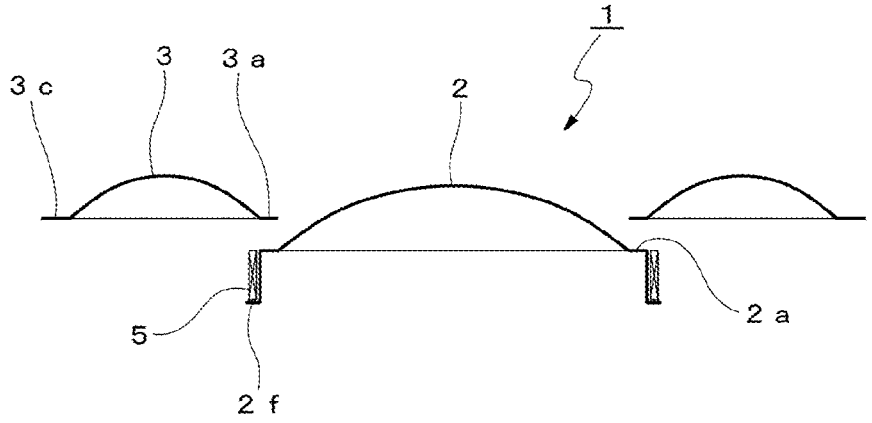
FIG. 6 is a cross-sectional view illustrating a fifth embodiment of the acoustic diaphragm according to the present invention.

In the fifth embodiment illustrated in FIG. 6, the center dome member includes a cylindrical part outside the first plane part 2*a* subsequent to the center dome 2 and includes a flange part 2*f* at a rear end of the cylindrical part. The cylindrical part extends to the side of the back surface of the first plane part 2*a*. The voice coil 5 is mounted on the cylindrical part in a positioned state by using the flange part 2*f*.

Figure 7:
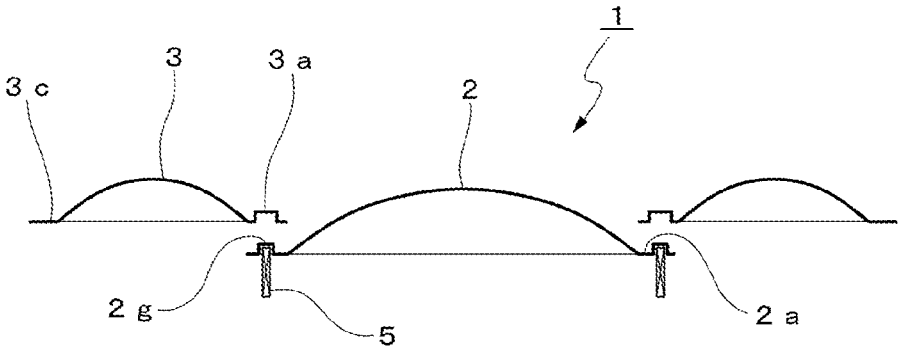
FIG. 7 is a cross-sectional view illustrating a sixth embodiment of the acoustic diaphragm according to the present invention.

In the sixth embodiment illustrated in FIG. 7, the center dome member includes an annular convex part 2*g* along the outer periphery of the center dome 2 on the first plane part 2*a* subsequent to the center dome 2. The convex part 2*g* projects to the front surface. Furthermore, the second plane part 3*a* subsequent to the sub dome 3 is formed with an annular concave part that receives the annular convex part 2*g*. The second plane part 3*a* is overlapped on the first plane part 2*a* by using unevenness between these convex parts 2*g* and concave parts.

The voice coil 5 is attached by the adhesive 4 (not illustrated in FIG. 7) by using a groove on the side of the back surface of the first plane part 2*a* in which the annular convex part 2*g* is formed.

Figure 8:
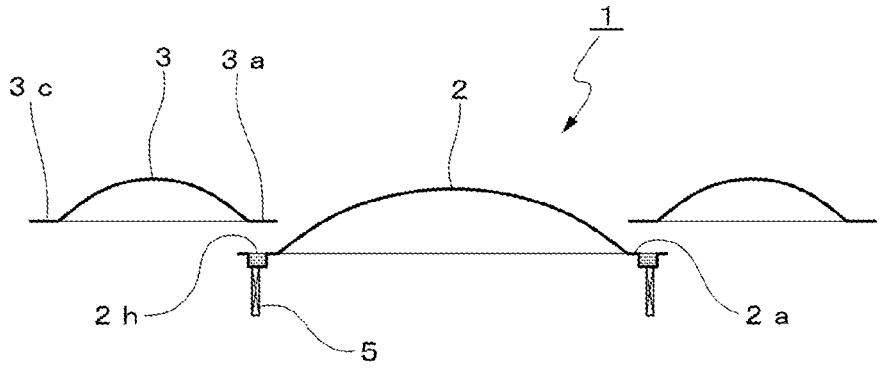
FIG. 8 is a cross-sectional view illustrating a seventh embodiment of the acoustic diaphragm according to the present invention.

In the seventh embodiment illustrated in FIG. 8, the center dome member includes an annular storage groove 2*h* for an adhesive along the outer periphery of the center dome 2, in the first plane part 2*a* subsequent to the center dome 2. The storage groove 2*h* stores an excess adhesive. Therefore, the problem that an adhesive overflows and solidifies between the center dome member and the sub dome member is solved. The voice coil 5 is attached to the side of a back surface of the storage groove 2*h* by the adhesive 4 (not illustrated in FIG. 8).

Figure 9:
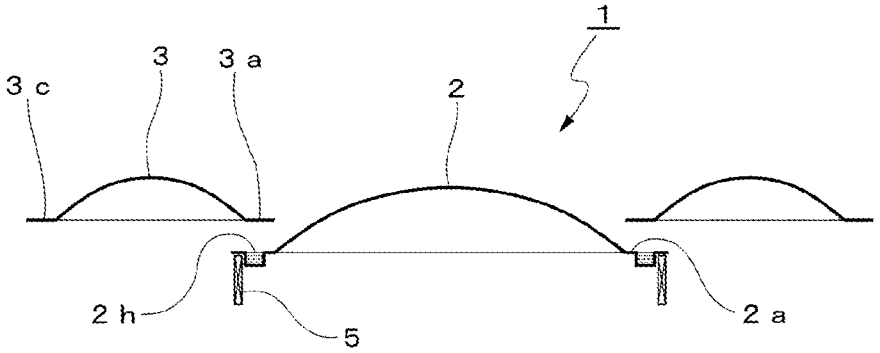
FIG. 9 is a cross-sectional view illustrating an eighth embodiment of the acoustic diaphragm according to the present invention.

The eighth embodiment illustrated in FIG. 9 is configured in the same manner as the seventh embodiment. That is, for example, the center dome member includes the annular storage groove 2*h* for an adhesive along the outer periphery of the center dome 2, in the first plane part 2*a* subsequent to the center dome 2. However, the voice coil 5 is attached by the adhesive 4 (not illustrated in FIG. 9) along the outside of the storage groove 2*h*.

As apparent from the above description, the acoustic diaphragm 1 according to the present invention obtains the operation effects described in the field of the effects of the invention such as it is possible to improve productivity by facilitating positioning between the center dome member and the sub dome member.

Furthermore, the aforementioned embodiments assume an acoustic diaphragm and an electroacoustic transducer used for dynamic headphones. However, the acoustic diaphragm and the electroacoustic transducer according to the present invention are not limited to the acoustic diaphragm and the electroacoustic transducer used for the dynamic headphones. That is, for example, the acoustic diaphragm according to the present invention can also be employed for canal type headphones (earphones) in which a diameter of an acoustic diaphragm is about 5 mm, and even though the acoustic diaphragm according to the present invention is used for an electroacoustic transducer other than headphones, it is possible to obtain the same operation effects.

The invention claimed is:

1. A method of manufacturing an acoustic diaphragm, wherein the acoustic diaphragm comprises:
- a center dome member; and
- a sub dome member, the center dome member comprises:
- a center dome; and
- an annular first plane part that is disposed along an outer periphery of the center dome and formed integrally with the center dome, the sub dome member comprises:
- a sub dome; and
- an annular second plane part that is disposed along an inner periphery of the sub dome and formed integrally with the sub dome, the first plane part comprises:
- a rising part of the center dome;
- a first front surface; and
- a first back surface, the second plane part comprises:
- an inner peripheral edge;
- a second front surface; and
- a second back surface, the center dome is formed of a material different from a material of the sub dome, the sub dome surrounds a periphery of the center dome, and the inner peripheral edge coincides with the rising part, the method of manufacturing the acoustic diaphragm comprising the steps of:

preparing the center dome member and the sub dome member; and joining the second back surface to the first front surface in a state where the inner peripheral edge is aligned with the rising part.

2. The method of manufacturing an acoustic diaphragm according to claim 1, wherein, in the step of joining the second back surface to the first front surface, an adhesive is interposed between the first front surface and the second back surface to join the first plane part and the second plane part.

* * * * *